US007114715B1

(12) United States Patent
Kirk

(10) Patent No.: US 7,114,715 B1
(45) Date of Patent: Oct. 3, 2006

(54) EXTENDABLE ALUMINUM BAR CLAMP

(75) Inventor: Ben Kirk, Camarillo, CA (US)

(73) Assignee: Central Purshasing LLC, Carmarillo, CA (US)

( * ) Notice: Subject to any disclaimer, the term of this patent is extended or adjusted under 35 U.S.C. 154(b) by 0 days.

(21) Appl. No.: 11/128,517

(22) Filed: May 13, 2005

(51) Int. Cl.
*B25B 1/02* (2006.01)

(52) U.S. Cl. ..... 269/147; 269/6; 269/3

(58) Field of Classification Search ..... 269/147, 269/149, 249, 229, 196, 143, 901
See application file for complete search history.

(56) References Cited

U.S. PATENT DOCUMENTS 1,583,611 A * 5/1926 Seely ..... 269/146
3,220,691 A * 11/1965 Dudley ..... 249/18
5,064,178 A * 11/1991 Nimtz ..... 269/41
6,089,556 A * 7/2000 Whiteford ..... 269/149
6,530,565 B1 3/2003 Simpson
6,554,264 B1 * 4/2003 Alford ..... 269/147
6,708,966 B1 3/2004 Troudt

* cited by examiner

*Primary Examiner*—Lee D. Wilson
(74) *Attorney, Agent, or Firm*—Amster, Rothstein & Ebenstein

(57) ABSTRACT

A bar clamp including a first bar member and a second bar member with the second bar member telescoping out from the first bar member. A securing mechanism, such as a pin in the first member, releasably secures the members together at a preferred telescoping position. The second bar member has a jaw member that can be advanced or retracted by means of a linear actuator and the first bar member has a jaw member that can be adjusted by positioning the cam-action locking mechanism in one of the notches disposed along the length of the first bar member. As a result of the telescoping relationship of the bar members, workpieces of varying sizes may be clamped between the jaw members without the need of multiple bar clamps of varying lengths.

11 Claims, 5 Drawing Sheets

EXTENDABLE ALUMINUM BAR CLAMP

FIELD OF INVENTION

The present invention relates to clamps generally, and more specifically to adjustable bar clamps capable of applying a clamping force at a plurality of working lengths.

BACKGROUND OF THE INVENTION

Bar clamps are well known in many applications, including to the construction industry as well as to craftsmen, for use in holding a work piece in a fixed position. Typically, a bar clamp is used to hold multiple objects together for gluing, welding, or other purposes where it is advantageous to temporarily retain the multiple objects comprising the workpiece in a fixed position.

A bar clamp secures workpieces between the clamp's moveable arms. Different size workpieces can be accommodated by adjusting the clamp's jaw members along the length of the bar. A given bar clamp can accommodate workpieces ranging in size from a very small piece when the jaw members are disposed close together, up to a large piece when the jaw members are at opposite ends of the bar. The largest workpiece a bar clamp can accommodate is typically slightly smaller than the length of the bar. Working on projects with greatly varying workpiece sizes requires the purchase of multiple bar clamps since many larger objects will be larger than the operative length of a standard bar clamp, requiring the use of a longer bar clamp. However, overly long bar clamps are more expensive and their use can also be more difficult and/or clumsy than a shorter bar clamp.

The effective use of bar clamps in construction and craft wherein workpieces are of widely varying sizes require the use of multiple bar clamps. Manufacturers must fabricate and then ship the different length bar clamps. Switching manufacturing between different length bar clamps breaks up assembly line production. Shipping the longer bar clamps is inefficient and expensive because of the increased volume of each clamp, raising shipping costs and resulting in the shipment of fewer pieces in each shipping container. Hardware stores must stock larger inventories of bar clamps in order to have at least a few of each size on hand to accommodate the needs of their clientele. Workmen must purchase, and then find a way to transport and store, multiple bar clamps of varying lengths in order to ensure that the proper equipment is on hand at each project.

After the manufacturing cost, typically the single largest cost of getting a good to market is shipping. The more space-efficiently a product can be packed, the greater the savings to the manufacturer, and in turn, the consumer. Similarly, storage space is often a big factor in consumer purchasing decisions. Lengthy and unwieldy bar clamps can result in the use of incorrectly-sized bar clamps or abandonment of a project rather than consumer purchase of an unwieldy and limited-use extra-long bar clamp.

SUMMARY OF THE INVENTION

One object of the present invention is to provide a single bar clamp capable of this object is achieved in a typical bar clamp modified to include a two-member bar with one member extending from the other to a selective location where it is releasably secured. In a preferred embodiment, a first member telescopes from the tubular second member. A transverse hole and removable pin is located at the entry of the second member. The first member contains a plurality of transverse holes spaced along its length. The pin can be placed through the transverse hole in the second member and one of the transverse holes in the first member to prevent the first member from further movement. To adjust the length of the bar, the pin is removed and the first bar member is repositioned within the second bar member. After the first bar member has been repositioned, the pin is reinserted. Additional adjustments in the clamping length can be obtained through the two jaw members. The jaw member on the second bar member can be positioned in any notch disposed along the length of the second bar member. The first jaw member can be linearly advanced along the first bar member.

DETAILED DESCRIPTION OF THE PREFERRED EMBODIMENT

Figure 1:
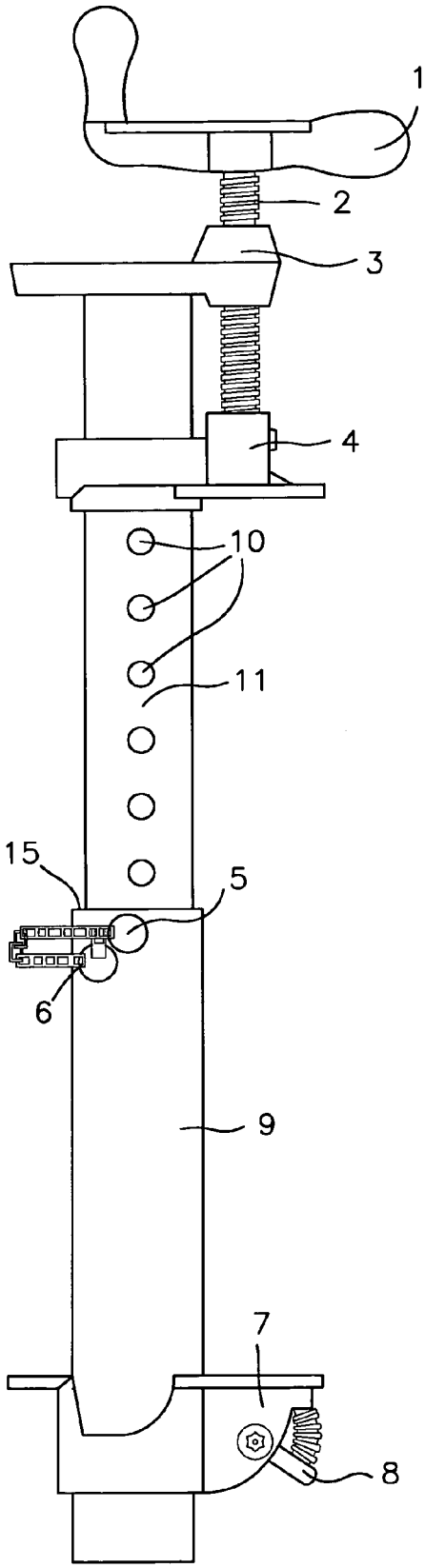
FIG. 1—Is a side view of the telescoping bar clamp.
Figure 2:
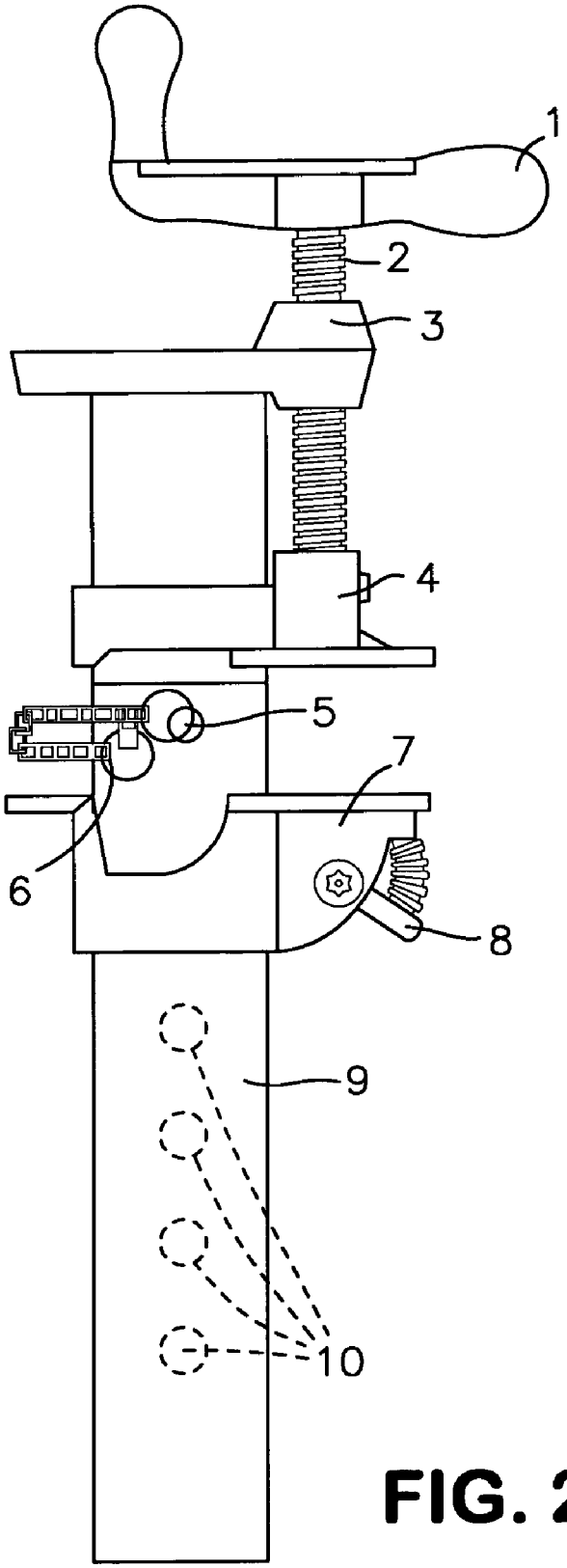
FIG. 2—Is a side view of the telescoping bar clamp.
Figure 3:
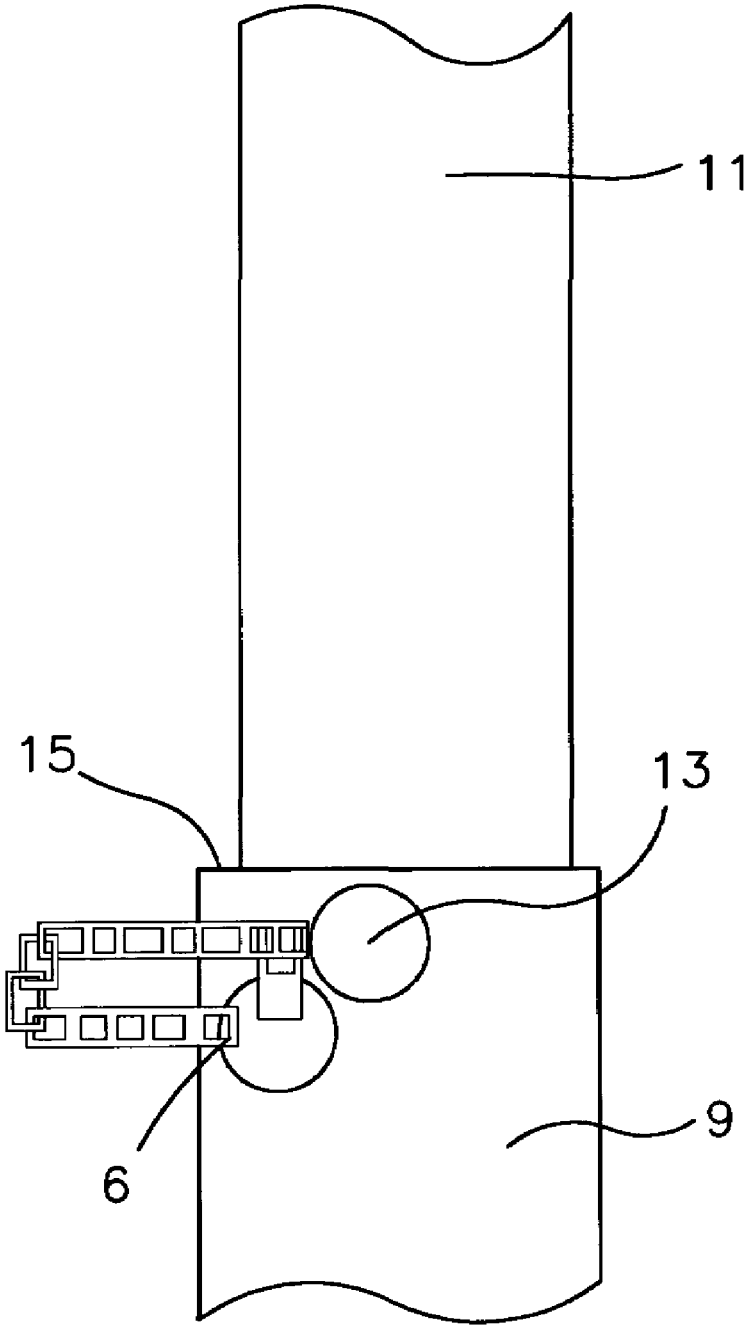
FIG. 3—Is a detail view of the locking pin and chain assembly.
Figure 4:
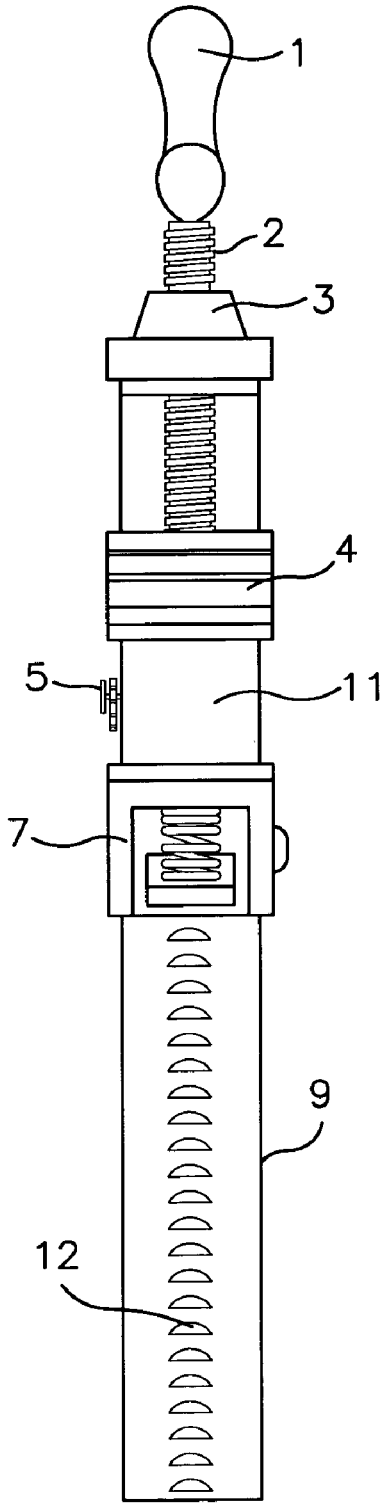
FIG. 4—Is a top view of the telescoping bar clamp.
Figure 5:
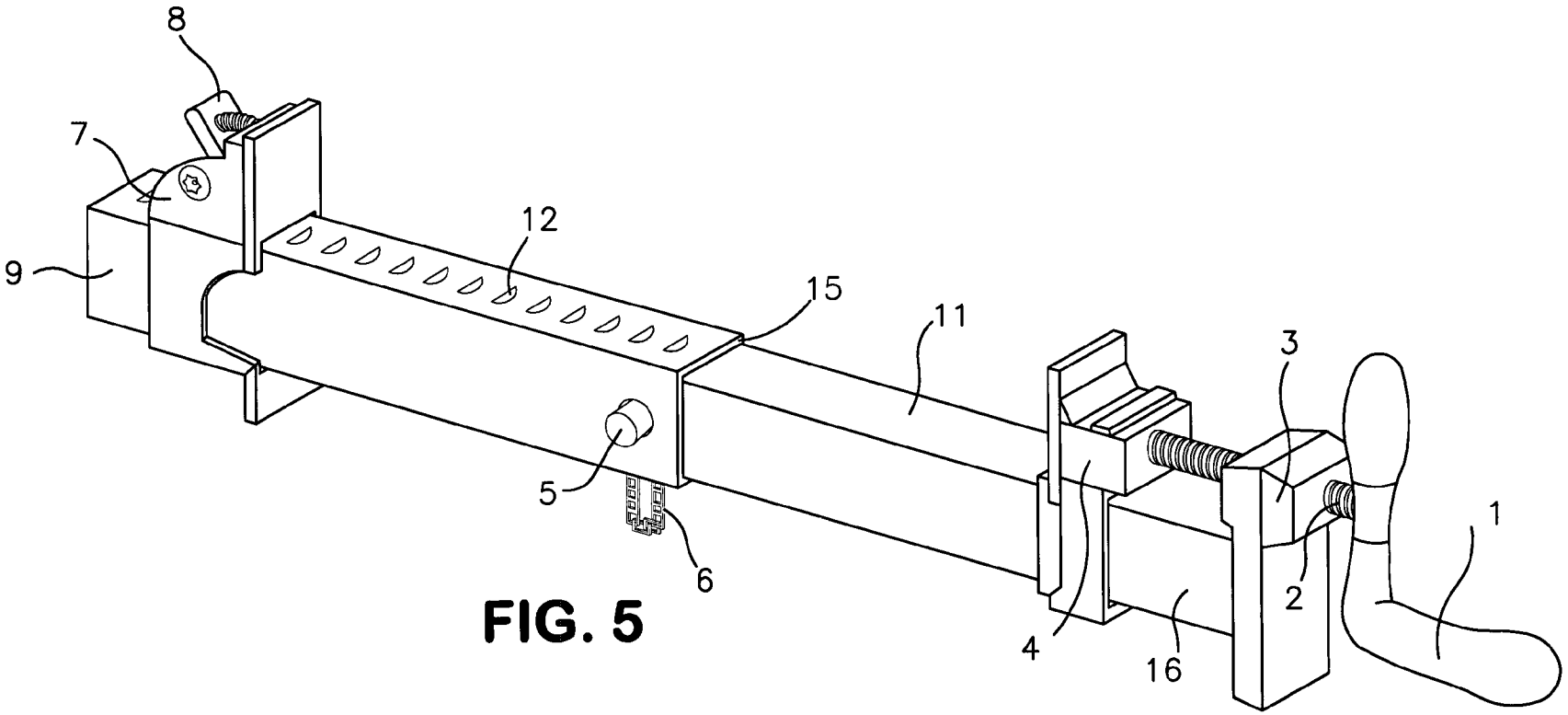
FIG. 5—Is a perspective view of the telescoping bar clamp.

The adjustable bar clamp of the present invention comprises a bar with inner 11 and outer 9 bar members and a first 4 and second 7 jaw member which are slidably disposed on the bar members. The bar members are tubular, with the inner bar member 11 slidably disposed within the outer bar member 9. In an alternate embodiment, the bar members can be u-shaped, without a full bottom wall portion. The inner bar member 11 has a plurality of spaced transverse holes 10. A locking pin 5 fits through a transverse hole 13 adjacent the entry end 15 to the outer bar member 9 and a transverse hole of the inner bar member 11 to fix the bar members in relation to one another. The locking pin 5 is secured to the outer bar member 9 by a chain 6. The inner and outer bar members 9, 11 are preferably made of metal according to strength considerations.

In the illustrated embodiments, the inner and outer bar members 9, 11 are rectangular in cross-section, but other cross-sectional configurations may be adopted, if desired. The inner bar member 11 may be of solid cross-section if additional rigidity is needed.

A linear actuator having a handle 1 a screw 2 stationary block 3, is operatively coupled to the first jaw member 4 at the end 16 of the inner bar member for selectively linearly advancing the first jaw member 4 towards and away from the second jaw member 7 to selectively close onto and apply pressure to the one or more workpieces interposed between the jaws. The first jaw member 4 is positioned by using the handle 1 of the linear actuator to turn the screw 2. Between the handle 1 and the first jaw member 4, the screw 2 of the linear actuator passes through an internally-threaded stationary block 3 which is affixed to the end of the inner bar member 11.

In an embodiment of the invention, the second jaw member 7 includes a cam-action locking mechanism 8 adapted to selectively fix the jaw at a selected position on the outer bar member 9. Notches 12 are located along the top length of the outer bar member 9. One end of the cam-action locking mechanism 8 engages the notches 12 of the outer bar member 9. The locking mechanism 8 fits into one of the notches 12, and outward pressure applied by the clamped workpieces lock the second jaw member 7 in the notch. The other end of the cam-action locking mechanism 8 operates as a lever. Depressing the lever end raises the engaging end of locking mechanism 8 from the notch and allows the second jaw member 7 to be moved along the outer bar member 9.

Thus, from the illustration and description of the preferred embodiment of the present invention, it is to be understood that many possible embodiments may be made of the invention without departing from the scope thereof, and that all matter herein set forth or shown is to be interpreted as illustrative and not in a limiting sense.

What is claimed is:

1. A bar clamp comprising:

a. a first bar having a central bore and a second bar, the second bar sized to fit in the central bore of the first bar and the bars being slideable with respect to one another;

b. a first jaw member attached and disposed in a linearly moveable guided relation to the first bar and the first jaw member further comprising a gripping portion;

c. a second jaw member attached to the second bar, the second jaw member comprising a locking mechanism adapted to fix the second jaw member at variable positions along the second bar, the locking mechanism further comprising a cam action mechanism wherein the cam action mechanism engages at least one of a plurality of notches evenly disposed along the top length of the second bar member; and d. a locking pin disposed between the first bar and the second bar and locking the bars together.

2. The bar clamp of claim 1 wherein:

a. the first bar having at least one end thereof extending beyond at least one end of the second bar member, the first bar having at least one transverse hole therein for registry with a transverse retainer hole located near one end of the second bar; and b. the retainer pin being releasably received within the transverse holes of the first and second bars.

3. The bar clamp of claim 1 wherein the first jaw member is disposed in linearly moveable guided relation with the first bar and the second jaw member is permanently fixed at one end of the second bar member.

4. The bar clamp of claim 1 wherein the first jaw member is disposed in linearly moveable guided relation with the second bar and the second jaw member is permanently fixed at one end of the first bar member.

5. The bar clamp of claim 1 wherein:

a. the gripping portion comprising a planar surface;

b. the cam action mechanism further comprising a lever and return spring.

6. A clamping assembly comprising:

a. a first bar member positioned within a second bar member; and b. first and a second clamp jaw members, the first clamp jaw member attached to a linear actuator and disposed in linearly moveable guided relation with the first bar member and the second clamp jaw member attached to the second bar member such that a maximum distance between the first and second clamp jaw members may be increased by sliding the first bar member with respect to the second bar member, the second jaw member comprising a locking mechanism the locking mechanism adapted to fix the second jaw member at variable positions along the second bar member, the second jaw member further comprising a cam-action mechanism capable of engaging at least one of a plurality of notches evenly disposed along the top length of the second bar member, the cam-action mechanism and notches adapted to fix the second jaw member at variable positions along the second bar member.

7. The clamping assembly of claim 6, wherein the first bar member and the second bar member being of tubular rectangular cross-sectional configuration.

8. The clamping assembly of claim 6, wherein:

a. the first bar having at least one end thereof extending beyond at least one end of the second bar member, the first bar member having at least one transverse hole therein for registry with a transverse retainer hole located near one end of the second bar member; and b. a retainer pin being releasably received within the transverse holes of the first and second bar members for releasably securing the second bar member to the first bar member.

9. The clamping assembly of claim 8, wherein the retainer pin is secured to the second bar member by a chain.

10. The clamping assembly of claim 6, wherein the first jaw member is disposed in linearly moveable guided relation with the first bar member and the second jaw member is fixedly disposed on the second bar member.

11. A clamping assembly as in claim 6, wherein:

a. the first jaw member further comprising a first jaw member gripping portion; and b. the second jaw member further comprising a a second jaw member gripping portion.

* * * * *